US006557375B1

(12) United States Patent
Simmons et al.

(10) Patent No.: US 6,557,375 B1
(45) Date of Patent: May 6, 2003

(54) JEWELRY SYSTEM

(76) Inventors: Peggy A. Simmons, 16044 Chalfonte, Detroit, MI (US) 48227; Helen S. Washington, 16046 Chalfonte, Detroit, MI (US) 48227

( * ) Notice: Subject to any disclaimer, the term of this patent is extended or adjusted under 35 U.S.C. 154(b) by 0 days.

(21) Appl. No.: 09/844,330

(22) Filed: Apr. 27, 2001

(51) Int. Cl.[7] ..... A44C 13/00
(52) U.S. Cl. ..... 63/1.15; 63/1.11; 63/1.14
(58) Field of Search ..... 63/1.11, 1.14, 63/1.15, 18, 19, DIG. 2; 362/104; 239/55

(56) References Cited

U.S. PATENT DOCUMENTS

| | | | | | |
|---|---|---|---|---|---|
| 168,972 | A | * | 10/1875 | Dayton | 239/55 |
| 477,217 | A | * | 6/1892 | McCoy | 239/55 |
| 718,562 | A | * | 1/1903 | Blackinton | 63/19 |
| 761,083 | A | * | 5/1904 | Long | 63/19 |
| 1,267,067 | A | * | 5/1918 | Flagg | 63/14.6 |
| 1,683,545 | A | | 9/1928 | Harris | |
| 2,740,662 | A | | 4/1956 | Scott | |
| D243,936 | S | | 4/1977 | Balestra | |
| 4,023,712 | A | | 5/1977 | Babiak et al. | |
| 4,056,951 | A | * | 11/1977 | Black | 63/13 |
| 4,452,052 | A | | 6/1984 | Hodge | |
| 4,785,642 | A | * | 11/1988 | Chin et al. | 63/1.13 |
| 4,972,684 | A | | 11/1990 | Aitken | |
| 5,031,419 | A | * | 7/1991 | Gelman | 63/12 |
| 6,381,984 | B1 | * | 5/2002 | Russo et al. | 63/1.15 |

FOREIGN PATENT DOCUMENTS

| | | | | |
|---|---|---|---|---|
| FR | 2 593 038 A1 | * | 7/1987 | 63/13 |
| FR | 2 696 623 A1 | * | 4/1994 | 63/DIG. 2 |
| GB | 2 243 760 A | * | 11/1991 | 63/18 |

* cited by examiner

*Primary Examiner*—J. J. Swann
*Assistant Examiner*—Ruth C. Rodriguez

(57) ABSTRACT

A jewelry system for emitting a fragrance. The jewelry system includes a pendant for attaching to a portion of a user. The pendant includes a first half and a second half that may be pivotally coupled together such that an interior of the pendant is defined. The pendant includes a hole extending through the first half. A fragrance assembly is provided for emitting a fragrance from the interior of the pendant. The fragrance assembly includes a fragrant liquid for emitting a fragrance through the hole and an absorbent disk removably positioned in the interior of the pendant for absorbing the fragrant liquid.

16 Claims, 2 Drawing Sheets

JEWELRY SYSTEM

BACKGROUND OF THE INVENTION

1. Field of the Invention

The present invention relates to jewelry and more particularly pertains to a new jewelry system for emitting a fragrance.

2. Description of the Prior Art

The use of jewelry is known in the prior art. More specifically, jewelry heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,740,662; U.S. Pat. No. 4,452,052; U.S. Pat. No. 4,972,684; U.S. Pat. No. 1,683,545; U.S. Pat. No. 4,023,712; and U.S. Pat. No. Des. 243,936.

While these devices fulfill their respective, particular objectives and requirements, the aforementioned patents do not disclose a new jewelry system. The inventive device includes a pendant for attaching to a portion of a user. The pendant includes a first half and a second half that may be pivotally coupled together such that an interior of the pendant is defined. The pendant includes a hole extending through the first half. A fragrance assembly is provided for emitting a fragrance from the interior of the pendant. The fragrance assembly includes a fragrant liquid for emitting a fragrance through the hole and an absorbent disk removably positioned in the interior of the pendant for absorbing the fragrant liquid.

In these respects, the jewelry system according to the present invention substantially departs from the conventional concepts and designs of the prior art, and in so doing provides an apparatus primarily developed for the purpose of emitting a fragrance.

SUMMARY OF THE INVENTION

In view of the foregoing disadvantages inherent in the known types of jewelry now present in the prior art, the present invention provides a new jewelry system construction wherein the same can be utilized for emitting a fragrance.

The general purpose of the present invention, which will be described subsequently in greater detail, is to provide a new jewelry system apparatus and method which has many of the advantages of the jewelry mentioned heretofore and many novel features that result in a new jewelry system which is not anticipated, rendered obvious, suggested, or even implied by any of the prior art jewelry, either alone or in any combination thereof.

To attain this, the present invention generally comprises a pendant for attaching to a portion of a user. The pendant includes a first half and a second half that may be pivotally coupled together such that an interior of the pendant is defined. The pendant includes a hole extending through the first half. A fragrance assembly is provided for emitting a fragrance from the interior of the pendant. The fragrance assembly includes a fragrant liquid for emitting a fragrance through the hole and an absorbent disk removably positioned in the interior of the pendant for absorbing the fragrant liquid.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new jewelry system apparatus and method which has many of the advantages of the jewelry mentioned heretofore and many novel features that result in a new jewelry system which is not anticipated, rendered obvious, suggested, or even implied by any of the prior art jewelry, either alone or in any combination thereof.

It is another object of the present invention to provide a new jewelry system which may be easily and efficiently manufactured and marketed.

It is a further object of the present invention to provide a new jewelry system which is of a durable and reliable construction.

An even further object of the present invention is to provide a new jewelry system which is susceptible of a low cost of manufacture with regard to both materials and labor, and which accordingly is then susceptible of low prices of sale to the consuming public, thereby making such jewelry system economically available to the buying public.

Still yet another object of the present invention is to provide a new jewelry system which provides in the apparatuses and methods of the prior art some of the advantages thereof, while simultaneously overcoming some of the disadvantages normally associated therewith.

Still another object of the present invention is to provide a new jewelry system for emitting a fragrance.

Yet another object of the present invention is to provide a new jewelry system which includes a pendant for attaching to a portion of a user. The pendant includes a first half and a second half that may be pivotally coupled together such that an interior of the pendant is defined. The pendant includes a hole extending through the first half. A fragrance assembly is provided for emitting a fragrance from the interior of the pendant. The fragrance assembly includes a fragrant liquid for emitting a fragrance through the hole and an absorbent disk removably positioned in the interior of the pendant for absorbing the fragrant liquid.

Still yet another object of the present invention is to provide a new jewelry system that prevents a user's clothes or skin being stained by placing a perfume or oil on the skin or clothes. The present invention is ideal for users that can not place perfume directly on their skin due to allergies. It provides these individuals with the opportunity to wear fragrances that they would otherwise be unable to wear.

Even still another object of the present invention is to provide a new jewelry system that reduces dependency upon perfume spray bottles that are alleged to have harmful affects on the atmosphere. The present invention allows a user to use drops of a fragrant liquid instead of sprays.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
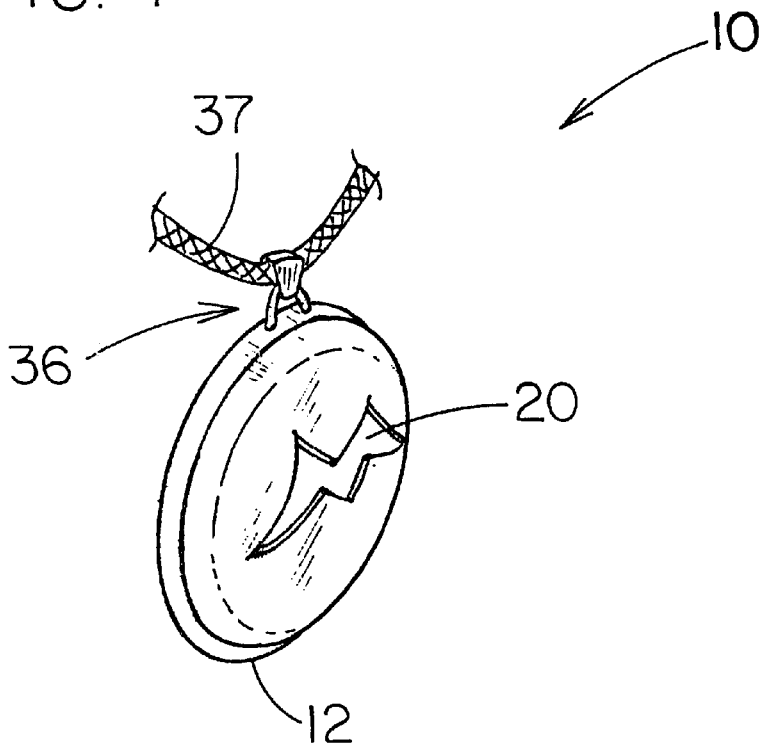
FIG. 1 is a schematic perspective view of a new jewelry system according to the present invention.
Figure 2:
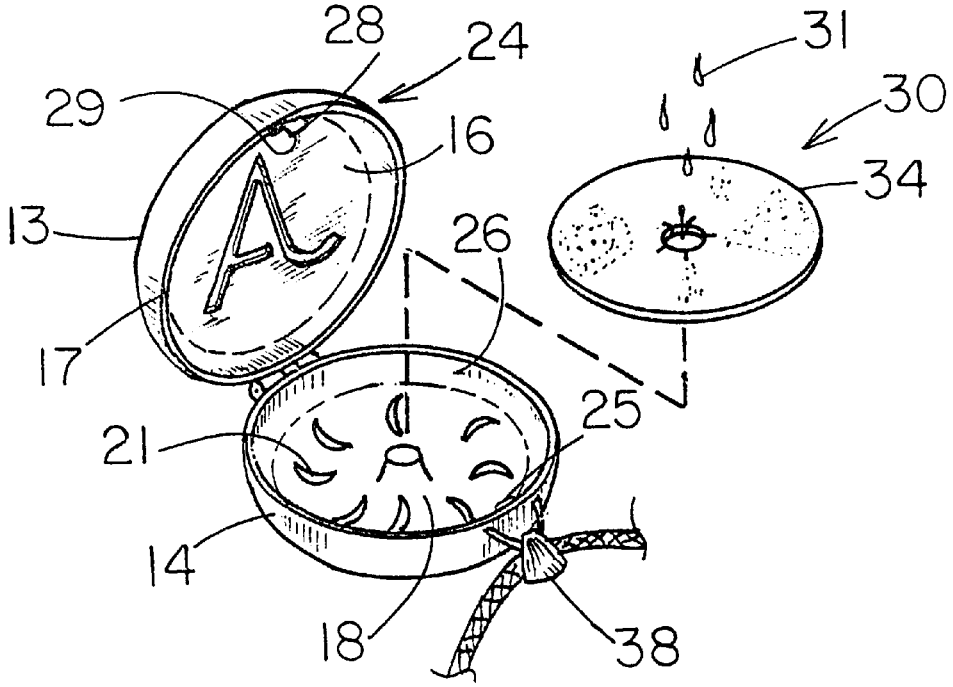
FIG. 2 is a schematic perspective view of the present invention.
Figure 3:
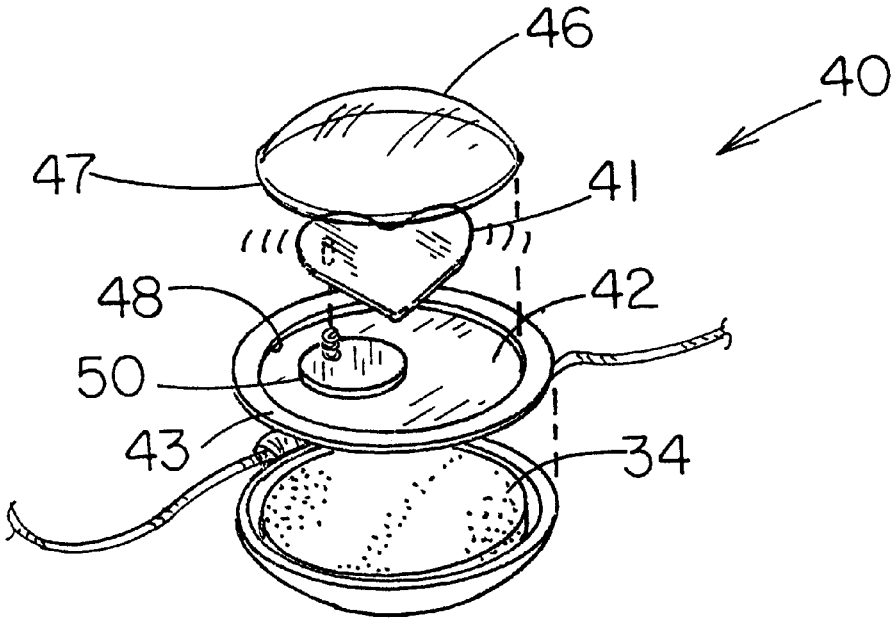
FIG. 3 is a schematic exploded view of the present invention.

With reference now to the drawings, and in particular to FIGS. 1 through 3 thereof, a new jewelry system embodying the principles and concepts of the present invention and generally designated by the reference numeral 10 will be described.

As best illustrated in FIGS. 1 through 3, the new jewelry system 10 generally comprises a pendant 12 for attaching to a portion of a user. The pendant 12 includes a first half 13 and a second half 14 that may be pivotally coupled together. Each of the halves 13 and 14 preferably includes a wall 16 and a peripheral lip 17 extending away from the wall 16. The first 13 and second 14 halves are positionable between an open position and a closed portion. In one embodiment of the present invention, the closed position is characterized by each of the peripheral lips 17 selectively abutted against each other and preventing access to an interior 18 of the pendant 12. The open position is characterized by each of the peripheral lips being positioned generally away from each other and providing access to the 18 interior of the pendant 12.

The pendant 12 may have any shape such as, for example, round, diamond, square, rectangle or triangle. In addition to the pendant 12 other types of jewelry may be employed, such as, for example, rings, bracelets and watches.

In one embodiment of the present invention, as illustrated in FIGS. 1 and 2, the wall 16 of the first half 13 has a hole 20 extending through the first half 13. The hole 20 may have a design such as, for example, a letter, an animal or scenery. The wall 16 of the second half 14 may includes a plurality of slots 21 extending through the wall 16 of the second half 14. The hole 20 and each of the slots 21 are in communication with the interior 18 of the pendant 12. Each of the slots 21 may be positioned in a generally radiating pattern away from a central portion of the wall 16 of second half 14.

A securing assembly 24 may be provided for securing the first half 13 and the second half 14 in the closed position. The securing assembly 24 may include a latch 25 that may be mounted on an inner surface 26 of the peripheral lip 17 of the second half 14. The latch 25 may have a generally arcuate. A hook 28 may be releasably coupled to the peripheral lip 17 of the first half 13. An end 29 of the hook 28 preferably selectively engages the latch 25 when each of the halves 13 and 14 are in the closed position.

A fragrance assembly 30 is provided for emitting a fragrance from the interior 18 of the pendant 12. The fragrance assembly 30 may include a fragrant liquid 31 for emitting a fragrance such as, for example, a floral or musk fragrance, however, any fragrance may be employed. The fragrant liquid 31 is stored in the interior 18 of the pendant 12. In one embodiment of the present invention, the fragrance emitted from the fragrant liquid 31 escapes through the hole 20 in the wall 16 of the first half 13. The fragrant liquid may comprise a perfume or an oil.

The fragrance assembly 30 may also include an absorbent disk 34 for absorbing the fragrant liquid 31. The absorbent disk 34 is removably positioned in the interior 18 of the pendant 12. The fragrant liquid 31 is applied to the absorbent disk 34 before being placed in the interior 18 of the pendant 12. The absorbent disk 34 may comprise a substantially absorbent material such as, for example, a cotton or cloth material.

A fastening assembly 36 may be provided for fastening the pendant 12 to a portion of the user. The fastening assembly 36 may include a fastening means 37 for fastening the pendant 12 to the portion of the user. The fastening means 37 may be mounted on the peripheral lip 17 of the second half 14. The fastening means 37 may comprise a lanyard. Other types of fastening means 37 may be employed such as, for example, a clip, or a chain.

A clasp means 38 may be provided for fastening a portion of the fastening means 37 to the peripheral lip 17 of the second half 14. The clasp means 38 may be mounted on an outer surface 39 of the peripheral lip 17 of the second half 14.

As illustrated in FIG. 3, a charm assembly 40 may be provided for displaying a charm. The charm assembly 40 may include a charm member 41 that may be mounted in a recess 42 extending into an outer surface 43 of the wall 16 of the first half 13. The charm member 41 may be designed to change colors and appear to be moving. The charm member 41 may comprise a liquid crystal display, however, any other device capable of changing colors may be employed. The charm member 41 may include a shape resembling a heart or angel.

A cover 46 may be provided for selectively covering the recess 42 in the wall 16 of the first half 13 and securing the charm member 41 in the recess 42. An edge 47 of the cover 46 may be abutted against an inner surface 48 of the recess 42 for securing the cover 46 to the first half 13. The cover 46 may comprise a generally transparent material for observing the charm member 41 through the cover 46.

A power supply 50 may be provided for selectively providing power to the charm member 41. The power supply 50 is preferably electrically connected to the charm member 41. The power supply 50 may be mounted in the recess 42. The power supply 50 may comprise a battery.

In use, heat from a user's body enters the plurality of slots 21 extending through the wall 16 of the second half 14. The heat causes the fragrant liquid 31 to evaporate emitting the fragrance through the hole 20 in the wall 16 of the first half 13 of the pendant 12. The charm member 41 may change colors creating the appearance that the charm is moving, for instance, if the charm member 41 is shaped like a heart it may appear to be beating or if the charm member 41 is shaped like a bird its wings may appear to be moving.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by he present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A jewelry system for emitting a fragrance, said system comprising a charm assembly for displaying a charm, said charm assembly including:

a pendant for attaching to a portion of a user, said pendant having a first half and a second half being pivotally coupled together, said pendant having an interior, said pendant having a hole extending through said first half into said interior;

a fragrance assembly for emitting a fragrance from said interior of said pendant, said fragrance assembly including:

a fragrant liquid; and an absorbent disk for absorbing said fragrant liquid, said absorbent disk being removably positioned in said interior of said pendant;

each of said halves of said pendant having a wall and a peripheral lip extending away from said wall, said hole extending through said wall of said first half; and a charm member being mounted in a recess extending into an outer surface of said wall of said first half; and a cover for selectively covering said recess in said wall of said first half and securing said charm in said recess.

2. The jewelry system of claim 1, wherein an edge of said cover is abutted against an inner surface of said recess.

3. The jewelry system of claim 1, wherein said cover comprises a generally transparent material.

4. The jewelry system of claim 1, wherein said hole has a design.

5. The jewelry system of claim 4, wherein said design comprises a letter.

6. The jewelry system of claim 1, additionally including a power supply for selectively providing power to said charm member, said power supply being removably mounted in said recess.

7. The jewelry system of claim 6, wherein said power supply comprises a battery.

8. The jewelry system of claim 1, wherein said charm member is adapted for changing colors.

9. The jewelry system of claim 8, wherein said charm member comprises a liquid crystal display.

10. The jewelry system of claim 9, wherein said charm has a shape resembling a heart.

11. The jewelry system of claim 10, wherein said wall of said second half has a plurality of slots extending through said wall of said second half.

12. The jewelry system of claim 11, wherein said first and second halves are positionable between an open position and a closed portion, wherein said closed position is characterized by each of said peripheral lips being selectively abutted against each other and preventing access to said interior of said pendant, wherein said open position is characterized by each of said peripheral lips being positioned generally away from each other and providing access to an interior of said pendant.

13. The jewelry system of claim 12, additionally including a securing assembly for securing said first half and said second half in said closed position, said securing assembly including:

a latch being mounted on an inner surface of said peripheral lip of said second half; and a hook being releasably coupled to said peripheral lip of said first half, an end of said hook selectively engaging said latch when each of said halves are in said closed position.

14. The jewelry system of claim 12, additionally including a fastening assembly for fastening said pendant to a portion of the user, said fastening assembly including:

a fastening means being mounted on said peripheral lip of said second half; and a clasp means for fastening a portion of said fastening means to said peripheral lip of said second half, said clasp means being mounted on an outer surface of said peripheral lip of said second half.

15. The jewelry system of claim 14, wherein said fastening means comprises a lanyard.

16. A jewelry system for emitting a fragrance, said system comprising:

a pendant for attaching to a portion of a user, said pendant having a first half and a second half being pivotally coupled together, each of said halves having a wall and a peripheral lip extending away from said wall, said first and second halves being positionable between an open position and a closed portion, wherein said closed position is characterized by each of said peripheral lips being selectively abutted against each other and preventing access to said interior of said pendant, wherein said open position is characterized by each of said peripheral lips being positioned generally away from each other and providing access to an interior of said pendant;

wherein said wall of said first half has a hole extending therethrough, said hole having a design, said design comprising a letter, said wall of said second half having a plurality of slots extending through said wall of said second half, each of said slots being positioned in a generally radiating pattern away from a central portion of said wall of second half;

a securing assembly for securing said first half and said second half in said closed position, said securing assembly including:

a latch being mounted on an inner surface of said peripheral lip of said second half, said latch having a generally arcuate;

a hook being releasably coupled to said peripheral lip of said first half, an end of said hook selectively engaging said latch when each of said halves are in said closed position;

a fragrance assembly for emitting a fragrance from said interior of said pendant, said fragrance assembly including:

a fragrant liquid for emitting a fragrance, said fragrant liquid being stored in said interior of said pendant, wherein said fragrance emitted from said fragrant liquid escapes through said hole in said wall of said first half and each of said plurality of slots in said second half;

an absorbent disk for absorbing said fragrant liquid, said absorbent disk being removably positioned in said interior of said pendant, said fragrant liquid being applied to said absorbent disk, said absorbent disk comprising a substantially absorbent material;

a fastening assembly for fastening said pendant to a portion of the user, said fastening assembly including:

a fastening means for fastening said pendant to the portion of the user, said fastening means being mounted on said peripheral lip of said second half, said fastening means comprising a lanyard;

a clasp means for fastening a portion of said fastening means to said peripheral lip of said second half, said clasp means being mounted on an outer surface of said peripheral lip of said second half;

a charm assembly for displaying a charm, said charm assembly including:

a charm member being mounted in a recess extending into an outer surface of said wall of said first half, said charm member being adapted for changing colors, said charm member comprising a liquid crystal display, said charm member having a shape resembling a heart;

a cover for selectively covering said recess in said wall of said first half and securing said charm member in said recess, an edge of said cover being abutted against an inner surface of said recess, said cover comprising a generally transparent material; and a power supply for selectively providing power to said charm member, said power supply being electrically connected to said charm member, said charm member being mounted in said recess, said power supply comprising a battery.

* * * * *